United States Patent [19]

Oka

[11] 4,392,735

[45] Jul. 12, 1983

[54] MAGNETIC BRUSH DEVELOPING APPARATUS

[75] Inventor: Tateki Oka, Toyokawa, Japan

[73] Assignee: Minolta Camera Kabushiki Kaisha, Osaka, Japan

[21] Appl. No.: 265,564

[22] Filed: May 20, 1981

[30] Foreign Application Priority Data

Jun. 4, 1980 [JP] Japan ..... 55-78414[U]

[51] Int. Cl.[3] ..... G03G 15/09

[52] U.S. Cl. ..... 355/3 DD; 118/657; 118/658

[58] Field of Search ..... 355/3 DD; 118/657, 658

[56] References Cited

U.S. PATENT DOCUMENTS 4,140,388 2/1979 Ikesue ..... 355/15

4,235,194 11/1980 Wada et al. ..... 118/657

FOREIGN PATENT DOCUMENTS 55-41449 3/1980 Japan ..... 355/3 DD

*Primary Examiner*—Fred L. Braun

*Attorney, Agent, or Firm*—Wenderoth, Lind & Ponack

[57] ABSTRACT

A magnetic brush developing apparatus which has a developing sleeve rotatably driven in a specified direction, a magnetic roller provided within the developing sleeve and rotatably driven at a high speed in the same direction as the direction of rotation of the developing sleeve, and a scraper for scraping from the peripheral surface of the sleeve the magnetic developer conveyed along the surface thereof. The scraper is a thin metal plate and has a forward end portion shaped in the form of a circular arc having approximately the same curvature as the peripheral surface of the sleeve. The developer scraped off the sleeve surface is conveyed along the end portion of the scraper at a relatively high speed.

3 Claims, 4 Drawing Figures

MAGNETIC BRUSH DEVELOPING APPARATUS

BACKGROUND OF THE INVENTION

The present invention relates to a magnetic brush developing apparatus for developing latent electrostatic images on an image bearing surface with a magnetic developer to obtain toner images.

A magnetic brush developing apparatus developed in recent years includes a developing sleeve rotatable in a direction opposite to the direction of transport of a magnetic developer, a magnetic roller disposed within the developing sleeve and rotatable at a high speed in the same direction as the developing sleeve, and a scraper by which the developer conveyed on the peripheral surface of the developing sleeve is scraped off the peripheral surface.

Such a magnetic brush developing apparatus will be described below more specifically with reference to FIGS. 1A and 1B. In this apparatus, a magnetic developer is magnetically attracted to the peripheral surface of a developing sleeve 1 by the magnetic action of a magnetic roller 2 within the sleeve 1 to form a magnetic brush 3 of the developer. As the magnetic roller 2 rotates at a high speed in the direction of an arrow a, the magnetic brush 3 is conveyed on the peripheral surface of the developing sleeve 1 in the direction of the arrow c and brushes against the surface of a latent electrostatic image bearing member 4, for example an electrophotographic photoconductive drum, in a developing zone 5, whereby the latent electrostatic image on the member 4 is developed to a visible image in the zone 5. The developer used for developing the latent image by brushing against the surface of the image bearing member 4 in the zone 5 is conveyed further in the direction of the arrow c, is thereafter scraped off of the surface of the sleeve 1 by a scraper 6 and falls away from the scraper due to gravity.

Repeated experiments using such a magnetic brush developing apparatus have been conducted, and it has been found that the developer is liable to stagnate in the vicinity of the scraper 6, which gives rise to various problems. This will be described in greater detail. When the apparatus is used continuously for a prolonged period of time for developing latent electrostatic images, the developer stagnates in the vicinity of the scraper 6 and progressively forms an accumulation 7 of developer at the forward end portion of the scraper 6 adjacent the developing zone 5, as shown in FIG. 1B. As a result, movement of the developer in the developing zone 5 is impeded, causing a portion of the developer forming the accumulation 7 to come into contact with the surface of the image bearing member 4 in an area other than the zone 5. This produces a distinct fog on the visible image, i.e. the developed toner image, or removes a portion of developer from the accumulation 7, causing the developer particles to escape from the developer container through the clearance between the open end 8 of the developer container and the surface of the image bearing member 4. The developer particles will scatter and, stain the developing apparatus in the neighborhood of the clearance. It has been found that such difficulties are especially great when the magnetic developer used is a mixture of magnetic carrier particles of reduced size and toner particles having electrical insulating properties.

An analysis appears to indicate that the chief cause for the accumulation of developer 7 is the following.

When developer particles are scraped off the peripheral surface of the developing sleeve 1 by the scraper 6, the force acting on the developer particles to convey them along the guide surface of the scraper 6 in a direction away from the peripheral surface of the sleeve can be regarded as the sum of:

(i) The rolling force of the magnetic particles themselves which are contained in the developer and placed in a rolling motion by the rotation of the magnetic roller 2.

(ii) The pushing force exerted on the above-mentioned developer particles by those conveyed on the peripheral surface of the sleeve.

The rolling force is attenuated greatly as the developer particles scraped off by the scraper 6 are conveyed along the guide surface of the scraper 6 and thereby carried away from the magnetic roller 2. On the other hand, the pushing force is not sufficiently great to convey the scraped-off developer particles smoothly along the guide surface by pushing them from behind, since the developing sleeve 1 is rotated in a direction opposite to the direction of transport of the developer. Accordingly the overall force which acts to convey the scraped-off developer particles along the guide surface of the scraper 6 in a direction away from the sleeve surface is very small. This is considered to be responsible for the stagnation of developer which is likely to occur in the vicinity of the scraper 6 and which leads to the progressive accumulation of developer 7 in the neighborhood of the end portion of the scraper and the developing zone.

SUMMARY OF THE INVENTION

The main object of the present invention is to provide a novel and useful magnetic brush developing apparatus.

Another object of the invention is to provide a magnetic brush developing apparatus which is free from the drawbacks of the apparatus described above.

Another object of the invention is to provide a magnetic brush developing apparatus in which the developer scraped off the peripheral surface of a developing sleeve by a scraper is conveyed smoothly along the guide surface of the scraper.

Still another object of the invention is to provide a magnetic brush developing apparatus suitable for using therein a magnetic developer comprising a mixture of magnetic carrier particles of reduced size and toner particles having electrical insulating properties.

These and other objects of the invention are achieved by a magnetic brush developing apparatus according to the invention comprising a developing sleeve rotatably driven in a specified direction, a magnetic roller provided within the developing sleeve and rotatably driven at a high speed in the same direction as the direction of rotation of the developing sleeve for conveying a magnetic developer along the peripheral surface of the developing sleeve in a direction opposite to the direction of rotation of the developing sleeve, and a scraping member having a forward end pressed into contact with the peripheral surface of the developing sleeve for scraping the developer off the peripheral surface of the developing sleeve and having or capable of forming a first guide surface and a second guide surface, the first guide surface being positioned at the forward end portion of the scraping member for conveying, by the magnetic action resulting from the rotation of the magnetic roller, the developer in a direction along the peripheral surface of the sleeve at a speed higher than the speed of transport of the developer on the peripheral surface of the sleeve immediately after the developer is scraped off the peripheral surface of the sleeve, the second guide surface being operable to guide the developer conveyed along the first guide surface in a direction away from the peripheral surface of the sleeve.

More specifically the magnetic brush developing apparatus according to the invention has the following preferred features. The developer is conveyed along the first guide surface at approximately twice the speed of transport of the developer on the peripheral surface of the developing sleeve. The first guide surface has a length of at least 2.0 mm in the direction of transport of the developer and has a cross-section in the shape of a circular arc having approximately the same curvature as the peripheral surface of the sleeve. The developer which is moving along the first guide surface is subjected to the full magnetic action of the magnetic roller. The scraping member is made of thin metal plate, and the forward end portion of the member, which constitutes the first guide surface has a cross-section shaped in the shape of a circular arc having approximately the same curvature as the peripheral surface of the sleeve.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE INVENTION

Figure 2:
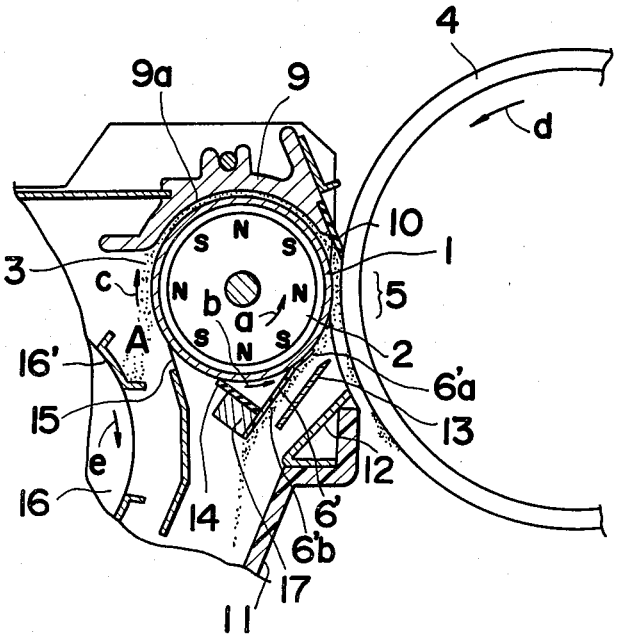
FIG. 2 is a fragmentary sectional view showing a magnetic brush developing apparatus according to the invention.
Figure 3:
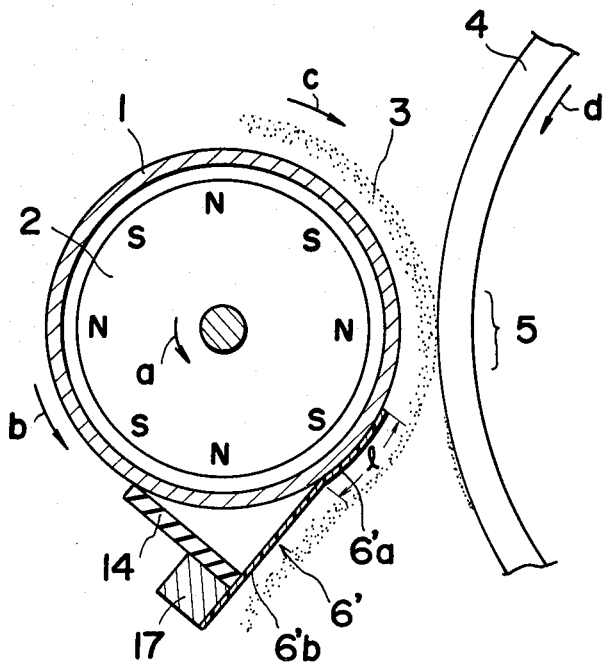
FIG. 3 is a view showing part of FIG. 2 on an enlarged scale.

As shown in FIGS. 2 and 3, the developing apparatus has a conventional electrophotograph photoconductive drum 4 which serves as a latent electrostatic image bearing member for bearing latent electrostatic images on its surface. The illustrated developing apparatus has a developing sleeve 1 and a magnetic roller 2 provided within the sleeve 1. The developing sleeve 1 has an outside diameter of 31 mm, is made of aluminum or like non-magnetic electroconductive material and is in spaced opposed relation to the surface of the drum 4 which is rotatable in the direction of the arrow d in proximity to the sleeve 1. When developing latent electrostatic images, the sleeve 1 is rotatingly driven at a speed of 30 rpm in the direction of the arrow b. The magnetic roller 2 has S poles and N poles arranged alternately along the circumference thereof and is driven at a speed of 1300 rpm in the same direction as the developing sleeve 1, i.e. in the direction of the arrow a, when operated for developing latent electrostatic images. Accordingly a magnetic developer attracted to the peripheral surface of the developing sleeve 1 in the form of a magnetic brush 3 is subjected to a conveying force acting in the direction of the arrow b and produced by the rotation of the sleeve 1 and also to a conveying force exerted in a direction opposite to the direction of the arrow a by the rotation of the magnetic roller 2. The former conveying force acts to convey the developer at a speed of about 5 cm/sec in the direction of the arrow b while the latter conveying force acts to convey the developer at a speed of about 10 cm/sec in a direction opposite to the arrow a. Consequently the resultant force conveys the developer along the peripheral surface of the sleeve at a speed of about 5 cm/sec in the direction of the arrow c.

An upper casing 9 disposed above the developing sleeve 1 has a circular arc-shaped cross-section inner surface 9*a* which is contacted by the ends of the bristles of the magnetic brush 3 formed on the sleeve surface. A resilient sheet 10 of electrical insulating material is attached to the upper casing 9 at the end thereof close to the drum 4 and forms an extension of the inner surface 9*a* and has a free end lightly contacting the surface of the drum 4.

Disposed below the developing sleeve 1 are a confining plate 12 fixed to a developer container 11 at one end thereof close to the drum 4 for preventing escape of developer particles, a deflecting plate 13 spaced from the peripheral surface of the sleeve for preventing scattering of developer particles, and a bucket roller 16 rotatably driven in the direction of the arrow e for feeding the magnetic developer to the peripheral surface of the developing sleeve 1. The developer confining plate 12 is connected to an unillustrated bias voltage source which applies to the plate 12 a bias voltage of the same polarity as the latent electrostatic image to be formed on the surface of the photoconductive drum 4. The deflecting plate 13 is grounded. The magnetic developer used for the present embodiment comprises a mixture of electrically insulating toner particles having a mean size of 11 μm and magnetic carrier particles of reduced size prepared by dispersing a magnetic powder in a resin and having a mean particle size of 21 μm.

A scraper 6', and auxiliary cleaner 14 and a cleaner 15, each made of a nonmagnetic resilient material, are provided under the developing sleeve 1 and have the forward ends thereof pressed into contact with the peripheral surface of the sleeve. The auxiliary cleaner 14 and the cleaner 15 are tangential to the sleeve 1 and face in a direction opposite the direction of rotation thereof, while the scraper 6' is positioned approximately in the direction of rotation of the sleeve 1. The scraper 6' and the auxiliary cleaner 14 are connected together and supported by a holder 17.

The portion of developer not transferred to drum 4 for developing a latent electrostatic image is conveyed along the peripheral surface of the sleeve 1 in the direction of the arrow c past the developing zone 5, is scraped off the peripheral surface of the sleeve by the scraper 6' and is allowed to fall from the scraper due to gravity. As is seen in FIG. 3, the scraper 6' has a first guide surface 6'*a* having a circular arc-shaped cross-section with the same curvature as the periphery of the sleeve 1, and a second guide surface 6'*b* extending away from the surface of sleeve 1. Immediately after the portion of developer is scraped off the sleeve surface, the first guide surface 6'*a* has the developer conveyed therealong by the magnetic action resulting from the rotation of the magnetic roller 2, in the direction of the peripheral surface of the sleeve at a speed higher than the speed of transport of the developer along the sleeve surface. The developer which has been conveyed along the first guide surface 6'a is then guided by the second guide surface 6'b in a direction away from the peripheral surface of the sleeve. The scraper 6' is made of a thin metal plate. According to the present embodiment, it is made, for example, of a thin phosphor bronze plate having a thickness of 50 μm. The first guide surface 6'a is formed by pressing the plate. More specifically an end portion of the phosphor bronze plate is shaped so as to have a cross-section in the form of a circular arc having approximately the same curvature as that of the peripheral surface of the sleeve to form the first guide surface 6'a. The first guide surface 6'a has a length l of 6 mm in the direction of transport of the developer. The inner side of the first guide surface 6'a is in face-to-face contact with the periphery of the developing sleeve 1. While the length l should be set at an optimum value in accordance with the diameter of the sleeve 1 and other factors, it has been found that the preferred length l is not smaller than 2 mm since if it is about 1 mm, the developer will not be scraped off as effectively, as will be described later.

A general description will now be given of the movement of the developer in the magnetic brush developing apparatus shown in FIGS. 2 and 3. With the rotation of the bucket roller 16, a portion of developer is conveyed by buckets 16' on the periphery of the bucket roller 16 to a position where it is subjected to the magnetic influence of the magnet roller 2, i.e. to a position A where the developer is fed to the sleeve 1. The developer is then attracted to the peripheral surface of the developing sleeve 1 in the form of a magnetic brush, further conveyed on the sleeve surface at a speed of about 5 cm/sec from the feeding position A in the direction of the arrow c and thereby brought into brushing contact with the surface of the photoconductive drum 4 in the developing zone 5. Since the surface of the drum 4 carries a latent electrostatic image already formed by a known process, the latent image is developed to a visible image by the magnetic brush in the zone 5. The developer on the sleeve not consumed in the developing zone is passed through the developing zone 5, further conveyed in the direction of the arrow c, then scraped off the sleeve surface by the scraper 6' and thereafter conveyed along the first and second guide surfaces 6'a and 6'b. Subsequently the developer falls into the container 11 by the action of gravity and is admixed with the other portion of developer by an unillustrated agitator. The used portion of developer is thereafter fed to the sleeve surface by the bucket roller 16 and reused for developing latent images.

Figure 1A:
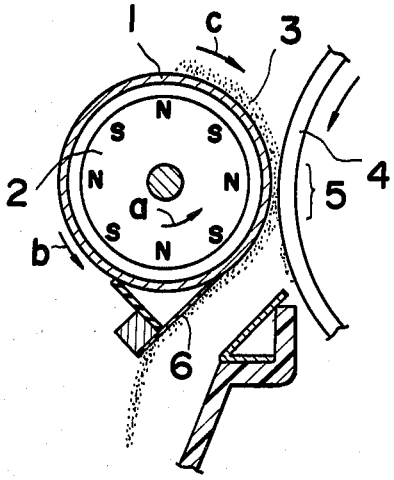
FIG. 1 A PRIOR ART
FIGS. 1A and 1B are fragmentary sectional views showing a magnetic brush developing apparatus of the new type developed in recent years, FIG. 1A showing the apparatus in a normal state, and FIG. 1B showing the apparatus after it has been in continuous operation for a long period of time for developing latent electrostatic images.
Figure 1B:
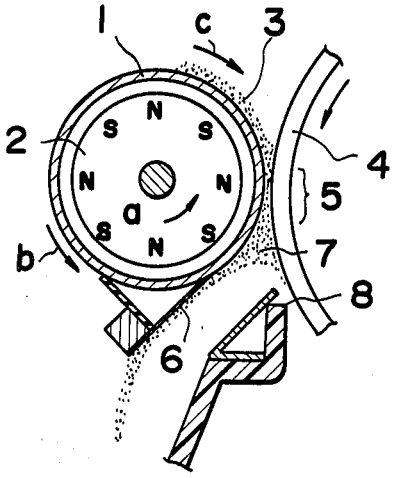
FIG. 1B PRIOR ART

It is especially noteworthy that the developer on the first guide surface 6'a of the scrpaer 6' is not subjected to the conveying force produced by the rotation of the sleeve 1 in the direction of the arrow b but is acted on magnetically only by the magnetic roller 2, so that the developer is conveyed on the first guide surface 6'a only by the conveying force exerted by the rotation of the magnetic roller 2 and acting in the direction opposite to the arrow a. Consequently, immediately after a portion of developer is scraped off the peripheral surface of the sleeve by the scraper 6', that portion of developer is conveyed along the first guide surface 6'a at a speed of about 10 cm/sec which is approximately twice the speed of transport of the developer on the sleeve surface, namely about 5 cm/sec. Because the developer is conveyed along the first guide surface 6'a at such an increased speed, the preceding portion of developer on the second guide surface 6'b is pushed forward from behind with a great force by the developer on the first guide surface 6'a. As a result, the developer which is being conveyed along the second guide surface 6'b in a direction away from the sleeve surface falls smoothly under the effect of gravity. Even if the rolling force of developer particles is greatly reduced as they are conveyed over the second guide surface 6'b of the scraper 6' away from the magnetic roller 2, the great pushing force exerted by the developer on the first guide surface 6'a does not permit any portion of developer to remain in the vicinity of the scraper 6'. In other words, even when latent electrostatic images are developed continually for a prolonged period of time by the use of the present embodiment, there is no likelihood that the developer will accumulate as indicated at 7 in FIG. 1B.

Although a thin phosphor bronze plate having a thickness of 50 μm and press-formed into shape is used as the scraper 6' in the present embodiment, other than nonmagnetic resilient plate or sheet can also be used. For example, a 50 μm thick polyester film can be used. When a fully resilient thin sheet, such a polyester film, is used for the scraper 6', there is no need to shape the sheet itself. In such a case, the forward end portion of the thin sheet can be intimately contacted with the peripheral surface of the sleeve by causing the magnetic roller to magnetically attract the developer on the guide surface toward the sleeve, so that the thin sheet is deformed to the shape shown in FIG. 3 to thereby form the first and second guide surfaces. This can be achieved merely by attaching the thin sheet in a suitable manner and adjusting the length of the thin sheet and the magnetic force of the magnetic roller, etc.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A magnetic brush developing apparatus comprising: a developing sleeve rotatably driven in a specified direction; a magnetic roller provided within the developing sleeve and rotatably driven at a high speed in the same direction as the direction of rotation of the developing sleeve for conveying a magnetic developer on the peripheral surface of the developing sleeve in a direction opposite to the direction of rotation of the developing sleeve; and a scraping member of non-magnetic material and having a forward end pressed in contact with the peripheral surface of the developing sleeve for scraping the developer off the peripheral surface of the developing sleeve and having a first guide surface and a second guide surface, the first guide surface being at the forward end portion of the scraping member and having a length of at least 2.0 mm in the direction of transport of the developer and has a cross-sectional shape in the direction of transport of the developer which is in the form of a circular arc having approximately the same curvature as the peripheral surface of said sleeve for conveying the developer along the first guide surface immediately after the developer is scraped off the peripheral surface of the sleeve in a direction parallel to the peripheral surface of the sleeve by the magnetic action due to the rotation of the magnetic roller and at a speed higher than the speed of transport of the developer on the peripheral surface of the sleeve, the second guide surface extending from said first guide surface in a direction away from the peripheral surface of the sleeve for guiding the developer along the first guide surface away from the peripheral surface of the sleeve.

2. A magnetic brush developing apparatus as claimed in claim 1, wherein said first surface has a shape for permitting the developer to be conveyed over the first guide surface at approximately twice the speed of transport of the developer on the peripheral surface of the developing sleeve.

3. A magnetic brush developing apparatus as claimed in claim 1, wherein the scraping member is a thin metal plate.

* * * * *